United States Patent [19]

Beneteau

[11] 4,173,181

[45] Nov. 6, 1979

[54] KNOCK-DOWN PRESS

[76] Inventor: Donald J. Beneteau, 1333 Front Rd. South, Amherstburg, Ontario, Canada

[21] Appl. No.: 938,858

[22] Filed: Sep. 1, 1978

[51] Int. Cl.[2] ..... B30B 1/32; B30B 15/04

[52] U.S. Cl. ..... 100/231; 100/269 R

[58] Field of Search ..... 100/214, 231, 269 R; 83/859; D15/123; 29/251

[56] References Cited

U.S. PATENT DOCUMENTS

| | | | |
|---|---|---|---|
| 2,728,288 | 12/1955 | Wissman | 100/214 X |
| 3,249,041 | 5/1966 | Johnson | 100/214 |
| 3,686,922 | 8/1972 | Bley | 100/231 X |

*Primary Examiner*—Billy J. Wilhite

*Attorney, Agent, or Firm*—Allen D. Gutchess, Jr.

[57] ABSTRACT

A knock-down press is provided which includes a high pressure intensifier cylinder and a knock-down frame. The overall frame includes two generally C-shaped frame members which are held in parallel relationship by a lower work-supporting bar affixed to lower portions of the frame members and by an upper cylinder-supporting bar affixed to upper portions of the frame members. The pressure intensifier cylinder has a lower end portion affixed to the cylinder-supporting bar. The lower and upper bars are affixed to the C-shaped frame members by shoulder screws having cylindrical shanks extending through bores in the bars and into aligned bores in the C-shaped frame members. This assures accurate alignment of the frame components.

10 Claims, 4 Drawing Figures

KNOCK-DOWN PRESS

This invention relates to a high pressure press embodying a pressure intensifier cylinder and a knock-down frame.

The pressure intensifier cylinder embodied in the invention can be of the type disclosed in my U.S. Pat. No. 3,875,365, or my U.S. Pat. No. 4,099,436. Intensifier cylinders of this type are capable of establishing high press pressures with relatively low fluid pressures. Pressures of several thousand psi at the workpiece can be achieved with air at a pressure of only one hundred psi, by way of example.

Heretofore, pressure intensifier cylinders have been installed in large press frames which are both heavy and bulky to ship. In contrast, the press in accordance with the present invention includes an overall frame which is readily assembled and disassembled. The overall frame includes two upright, generally C-shaped frame members, each including an upstanding web portion terminating at the ends in lower and upper, generally horizontally-disposed arms. A lower, workpiece-supporting bar has spaced portions affixed to upper edges of the lower arms. An upper, cylinder-supporting member has spaced portions similarly affixed to lower edges of the upper arms. The C-shaped frame members are thereby held in spaced, parallel relationship and the bars are also positioned in spaced, parallel relationship with respect to one another. A lower portion of a pressure intensifier cylinder is affixed to the upper bar, preferably by brazing, with a piston rod of the intensifier cylinder positioned perpendicularly to the workpiece-supporting bar.

In a preferred form, the bars are affixed to the arms by means of shoulder screws. Cylindrical shanks of these screws extend through cylindrical bores in the two bars and also extend into cylindrical bores or recesses in the edges of the horizontally-disposed arms, the screws being threaded into tapped recesses therebeyond. This assures accurate alignment of the various frame components. Nevertheless, the frame is relatively easy to assembly and disassemble. In particular, it can be shipped in a knocked-down condition to save substantially in shipping costs and also in storage costs.

It is, therefore, a principal object of the invention to provide a knock-down press utilizing a pressure intensifier cylinder having the advantages discussed above.

Many other objects and advantages of the invention will be apparent from the following detailed description of a preferred embodiment thereof, reference being made to the accompanying drawings, in which.

Figure 4:
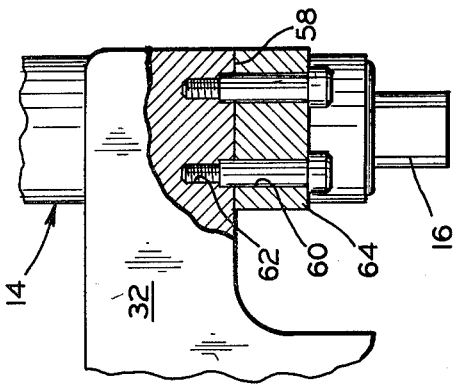
FIGS. 3 and 4 are somewhat enlarged, fragmentary views, with parts broken away and with parts in section, of components of the press of FIGS. 1 and 2.
Figure 3:
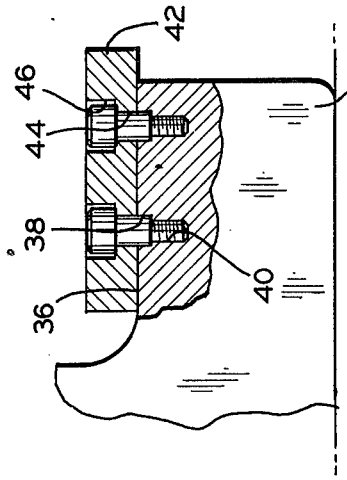
Figure 1:
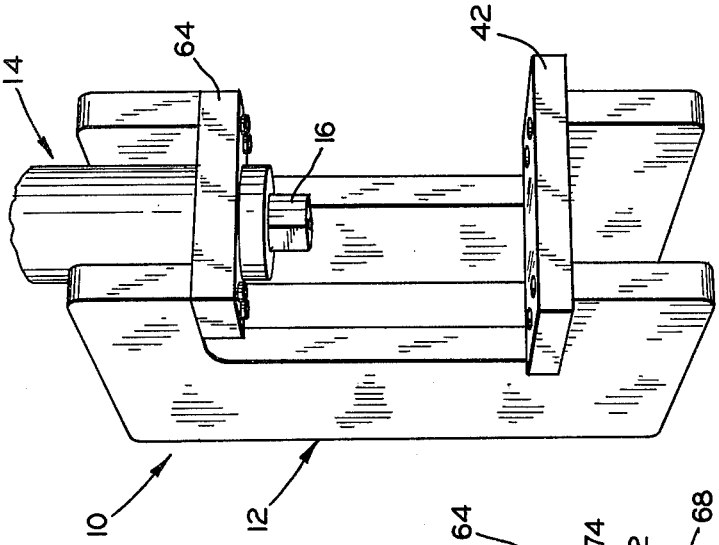
FIG. 1 is a somewhat schematic view in perspective of a knock-down press in accordance with the invention.

Referring particularly to FIG. 1, an overall fluid-operated press according to the invention is indicated at 10 and basically includes a press frame 12 and a pressure intensifier cylinder 14. The cylinder 14 is of the type disclosed in my aforesaid U.S. Pat. Nos. 3,875,365 and 4,099,436 and will not be discussed in detail. The cylinder 14 enables a piston rod 16 thereof to exert a pressure of several thousand psi on a workpiece with air supplied to an upper portion of the cylinder at a pressure of only one hundred psi, for example. The press frame 12 must have substantial strength to withstand such pressures without deflection and yet the frame 12 according to the invention is readily assembled and disassembled and can be shipped in a knock-down state with the cylinder 14, resulting in considerable saving in shipping costs and in storage costs.

Figure 2:
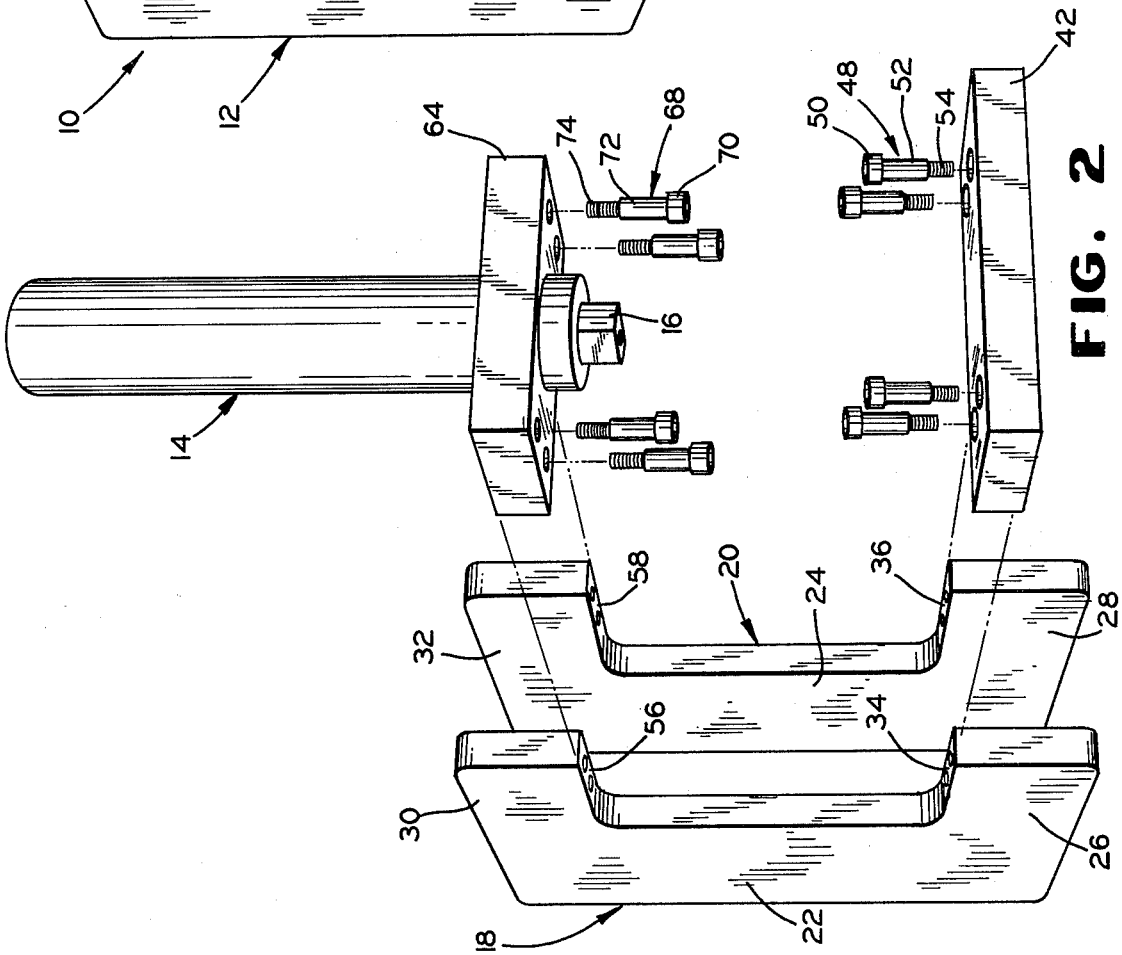
FIG. 2 is an exploded view in perspective of the press of FIG. 1.

Referring more particularly to FIG. 2, the press frame 12 includes two generally C-shaped frame members 18 and 20. The C-shaped frame members include vertically-disposed web portions 22 and 24 terminating in structurally-integral lower arms 26 and 28 and upper arms 30 and 32. The frame members 18 and 20 are each of one piece of steel and with a thickness from one-half to at least three inches. The web portions 22 and 24 also must be of substantial width to withstand deflection and are preferably at least as wide as the lower and upper arms are long.

The lower arms 26 and 28 have upper edges 34 and 36 which are disposed horizontally and have cylindrical bores 38 extending inwardly therefrom and terminating in tapped recesses 40.

A workpiece-supporting bar 42 is located on the upper edges 34 and 36 of the lower arms 26 and 28 and affixed thereto. End portions of the bar 42 have cylindrical bores 44 extending therethrough with upper recesses 46. Shoulder screws 48 are preferably used to affix the work-supporting bar 42 to the lower arms 26 and 28. Each of the shoulder screws 48 has a head 50 with a suitable noncircular recess for turning the screw. Each also has a cylindrical shank 52 and a threaded end 54. The cylindrical shank 52 exceeds the length of the bore 44 in the workpiece-supporting bar 42 and extends into the bore 38 in the upper edge of the lower arm, with the threaded end 54 turned into the tapped recess 40. With this arrangement, the workpiece-supporting bar 42 and the frame members 18 and 20 are assured of being accurately assembled.

Lower edges 56 and 58 of the upper arms 30 and 32 also have cylindrical bores 60 extending inwardly therefrom and terminating in tapped recesses 62. A cylinder-supporting bar 64 is located at the lower edges of the upper arms and affixed thereto. End portions of the bar 64 have cylindrical bores 66 extending therethrough and aligned with the cylindrical bores 60. Shoulder screws 68 are preferably used to affix the cylinder-supporting bar 64 to the upper arms 30 and 32. Each of the shoulder screws 68 has a head 70 with a suitable noncircular recess for turning the screw and each also has a cylindrical shank 72 and a threaded end 74. The cylindrical shank 72 exceeds the length of the bore 66 in the cylinder-supporting bar 64 and extends into the bore 60 in the lower edge of the upper arm, with the threaded end 74 turned into the tapped recess 62.

The cylinder-supporting bar 64 has a central opening therein through which the lower end of the cylinder 14 extends, with the cylinder suitably affixed thereto as by brazing to securely hold the cylinder in place. The lower edges 56 and 58 of the upper arms are parallel to the upper edges 34 and 36 of the lower arms to assure that the bars 42 and 64 will be in parallel relationship and that the piston rod 16 of the cylinder 14 will be perpendicular to the upper surface of the bar 42.

It will thus be seen that the entire press frame 12 can be assembled and disassembled with only the eight shoulder screws. The cylinder-supporting bar 64 is affixed permanently to the cylinder 14 but does not consume much additional space beyond the cylinder when packaged for shipment. The press frame can also be mass produced and thus available for immediate delivery. In addition, the lower bar or plate 42 can easily be removed for changing tooling or tooling for a specific job. Due to the compact size of the frame, the presses can be easily positioned around rotary table fixtures or the like to increase productivity. They can also be easily mounted on low friction ways to enable multiple operations.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A fluid-operated press comprising two upright, generally C-shaped frame members, each including a vertically disposed web portion terminating in lower and upper horizontally disposed arms, a lower workpiece-supporting bar, lower fastener means affixing spaced portions of said workpiece-supporting bar to upper edges of said lower arms, a fluid-operated cylinder, a cylinder-supporting bar affixed to a lower portion of said cylinder, upper fastener means affixing spaced portions of said cylinder-supporting bar to lower edges of said upper arms, said bars thereby positioning said generally C-shaped frame members in parallel, spaced relationship.

2. A fluid-operated press according to claim 1 characterized by the upper edges of said lower arms having cylindrical bores extending inwardly therefrom and terminating in tapped recesses, said work-supporting bar having bores extending therethrough and aligned with the cylindrical bores in said upper edges of said lower arms, said lower fastener means being shoulder screws having cylindrical shanks, the lengths of which exceed the lengths of said workpiece-supporting bar bores, the cylindrical shanks of said shoulder screws extending through said bores of said workpiece-supporting bar and into the bores of said lower arms.

3. A fluid-operated press according to claim 1 characterized by the lower edges of said upper arms having cylindrical bores extending inwardly therefrom and terminating in tapped recesses, said cylinder-supporting bar having bores extending therethrough and aligned with the cylindrical bores in said lower edges of said upper arms, said upper fastener means being shoulder screws having cylindrical shanks, the lengths of which exceed the lengths of said cylinder-supporting bar bores, the cylindrical shanks of said shoulder screws extending through said bores of said cylinder-supporting bar and into the bores of said upper arms.

4. A fluid-operated press according to claim 2 characterized by the lower edges of said upper arms having cylindrical bores extending inwardly therefrom and terminating in tapped recesses, said cylinder-supporting bar having bores extending therethrough and aligned with the cylindrical bores in said lower edges of said upper arms, said upper fastener means being shoulder screws having cylindrical shanks, the lengths of which exceed the lengths of said cylinder-supporting bar bores, the cylindrical shanks of said shoulder screws extending through said bores of said cylinder-supporting bar and into the bores of said upper arms.

5. A fluid-operated press according to claim 1 characterized by said cylinder being affixed to said cylinder-supporting bar by braze metal.

6. A fluid-operated press comprising a fluid-operated pressure intensifier cylinder, two upright, generally C-shaped frame members, each made of one piece of metal, each frame member including a vertically-disposed web portion terminating in structurally integral lower and upper horizontally-disposed arms, the width of said web portion being substantially at least equal to the lengths of said arms, a lower workpiece-supporting bar, lower fasteners affixing end portions of said workpiece-supporting bar to upper edges of said lower arms, a cylinder-supporting bar affixed to a lower portion of said cylinder, upper fasteners affixing end portions of said cylinder-supporting bar to lower edges of said upper arms, said bars thereby positioning said generally C-shaped frame members in parallel, spaced relationship with said bars being in parallel, spaced relationship.

7. A fluid-operated press according to claim 6 characterized by the upper edges of said lower arms having cylindrical bores extending inwardly therefrom and terminating in tapped recesses, said work-supporting bar having bores extending therethrough and aligned with the cylindrical bores in said upper edges of said lower arms, said lower fastener means being shoulder screws having cylindrical shanks, the lengths of which exceed the lengths of said workpiece-supporting bar bores, the cylindrical shanks of said shoulder screws extending through said bores of said workpiece-supporting bar and into the bores of said lower arms.

8. A fluid-operated press according to claim 6 characterized by the lower edges of said upper arms having cylindrical bores extending inwardly therefrom and terminating in tapped recesses, said cylinder-supporting bar having bores extending therethrough and aligned with the cylindrical bores in said lower edges of said upper arms, said upper fastener means being shoulder screws having cylindrical shanks, the lengths of which exceed the lengths of said cylinder-supporting bar bores, the cylindrical shanks of said shoulder screws extending through said bores of said cylinder-supporting bar and into the bores of said upper arms.

9. A fluid-operated press according to claim 7 characterized by the lower edges of said upper arms having cylindrical bores extending inwardly therefrom and terminating in tapped recesses, said cylinder-supporting bar having bores extending therethrough and aligned with the cylindrical bores in said lower edges of said upper arms, said upper fastener means being shoulder screws having cylindrical shanks, the lengths of which exceed the lengths of said cylinder-supporting bar bores, the cyklindrical shanks of said shoulder screws extending through said bores of said cylinder-supporting bar and into the bores of said upper arms.

10. A fluid-operated press according to claim 6 characterized by said cylinder being affixed to said cylinder-supporting bar by braze metal.

* * * * *